US006628161B2

(12) United States Patent
Ikeda

(10) Patent No.: US 6,628,161 B2
(45) Date of Patent: Sep. 30, 2003

(54) REFERENCE VOLTAGE CIRCUIT

(75) Inventor: Masuhide Ikeda, Nagano-ken (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 10/047,920

(22) Filed: Oct. 29, 2001

(65) Prior Publication Data

US 2002/0113642 A1 Aug. 22, 2002

(30) Foreign Application Priority Data

Oct. 30, 2000 (JP) ..... 2000-331251

(51) Int. Cl.[7] ..... G05F 1/10; G05F 3/02

(52) U.S. Cl. ..... 327/538; 327/543; 323/313

(58) Field of Search ..... 327/530, 538, 327/540, 541, 542, 543; 323/313

(56) References Cited

U.S. PATENT DOCUMENTS 4,519,086 A * 5/1985 Hull et al. ..... 375/376
4,614,882 A * 9/1986 Parker et al. ..... 326/34
4,760,288 A * 7/1988 Peczalski ..... 326/32
4,857,769 A * 8/1989 Kotera et al. ..... 327/541
4,984,256 A * 1/1991 Imai ..... 377/60
4,996,686 A * 2/1991 Imai et al. ..... 377/60
5,008,565 A * 4/1991 Taylor ..... 327/543
5,825,695 A * 10/1998 Hamaguchi ..... 164/218

* cited by examiner

*Primary Examiner*—Tuan T. Lam
(74) *Attorney, Agent, or Firm*—Harness, Dickey & Pierce, P.L.C.

(57) ABSTRACT

A depletion type PMOS transistor Q1 and an enhancement type PMOS transistor Q2 are serially connected to each other between power supply lines 1 and 2. A gate electrode of the PMOS transistor Q1 is formed from polysilicon including a P-type impurity and connected to a source electrode thereof. A gate electrode of the PMOS transistor Q2 is formed from polysilicon including an N-type impurity and connected to a drain electrode thereof. A voltage corresponding to a difference between a threshold voltage of the PMOS transistor Q1 and a threshold voltage of the PMOS transistor Q2 is generated at a mutually connected section of the both MOS transistors as a reference voltage.

5 Claims, 6 Drawing Sheets

REFERENCE VOLTAGE CIRCUIT

BACKGROUND OF THE INVENTION

1. Technical Field of the Invention

The present invention relates to a reference voltage circuit that generates a reference voltage of a constant magnitude even when a power supply voltage changes, which is used, for example, as a bias voltage for a constant power supply source of an operational amplifier.

2. Conventional Technology

Conventionally known reference voltage circuits of the type described above include, for example, a reference voltage source described in Japanese Utility Model Patent 62-16682, and a reference voltage circuit described in Japanese Patent 59-41203.

However, the conventional circuits mentioned above are each formed from many MOS transistors, for example, four of them. Such a circuit structure becomes disadvantageously complex. Therefore, it is desired to implement a reference voltage circuit with a simple structure that obtains a desired reference voltage.

Thus, it is a feature of the present invention to provide a reference voltage circuit with a simple structure that can obtain a desired reference voltage regardless of fluctuations in the power supply voltage.

SUMMARY OF THE INVENTION

To solve the problems described above and achieve the feature, the present invention is composed as follows.

Namely, the invention is characterized in that a depletion type first PMOS transistor and an enhancement type second PMOS transistor are serially connected to each other, wherein a gate electrode of the first PMOS transistor is formed from polysilicon including a P-type impurity and connected to a source electrode thereof, a gate electrode of the second PMOS transistor is formed from polysilicon including an N-type impurity and connected to a drain electrode thereof, and a voltage corresponding to a difference between a threshold voltage of the second PMOS transistor and a threshold voltage of the first PMOS transistor is generated at a common connection section of the both MOS transistors as a reference voltage.

By the structure described above, a voltage corresponding to a difference between a threshold voltage of the second PMOS transistor and a threshold voltage of the first PMOS transistor is generated as a reference voltage. The reference voltage is not affected by fluctuations in the power supply voltage VDD.

Also, the invention is characterized in that an enhancement type first PMOS transistor and a depletion type second PMOS transistor are serially connected to each other, wherein a gate electrode of the first PMOS transistor is formed from polysilicon including an N-type impurity and connected to a drain electrode thereof, a gate electrode of the second PMOS transistor is formed from polysilicon including a P-type impurity and connected to a source electrode thereof, and a voltage corresponding to a difference between a threshold voltage of the first PMOS transistor and a threshold voltage of the second PMOS transistor is generated at a common connection section of the both MOS transistors as a reference voltage.

By the structure described above, a voltage corresponding to a difference between a threshold voltage of the first PMOS transistor and a threshold voltage of the second PMOS transistor is generated as a reference voltage. The reference voltage is not affected by fluctuations in the power supply voltage VSS.

Furthermore, the invention is characterized in that a depletion type first NMOS transistor and an enhancement type second NMOS transistor are serially connected to each other, wherein a gate electrode of the first NMOS transistor is formed from polysilicon including an N-type impurity and connected to a source electrode thereof, a gate electrode of the second NMOS transistor is formed from polysilicon including a P-type impurity and connected to a drain electrode thereof, and a voltage corresponding to a difference between a threshold voltage of the second NMOS transistor and a threshold voltage of the first NMOS transistor is generated at a common connection section of the both MOS transistors as a reference voltage.

By the structure described above, a voltage corresponding to a difference between a threshold voltage of the second NMOS transistor and a threshold voltage of the first NMOS transistor is generated as a reference voltage. The reference voltage is not affected by fluctuations in the power supply voltage VDD.

Also, the invention is characterized in that an enhancement type first NMOS transistor and a depletion type second NMOS transistor are serially connected to each other, wherein a gate electrode of the first NMOS transistor is formed from polysilicon including a P-type impurity and connected to a drain electrode thereof, a gate electrode of the second NMOS transistor is formed from polysilicon including an N-type impurity and connected to a source electrode thereof, and a voltage corresponding to a difference between a threshold voltage of the first NMOS transistor and a threshold voltage of the second NMOS transistor is generated at a common connection section of the both MOS transistors as a reference voltage.

By the structure described above, a voltage corresponding to a difference between a threshold voltage of the first NMOS transistor and a threshold voltage of the second NMOS transistor is generated as a reference voltage. The reference voltage is not affected by fluctuations in the power supply voltage VSS.

DETAILED DESCRIPTION OF THE PREFERRED EMBODIMENTS

Embodiments of the present invention are described below with reference to the accompanying drawings.

Figure 1:
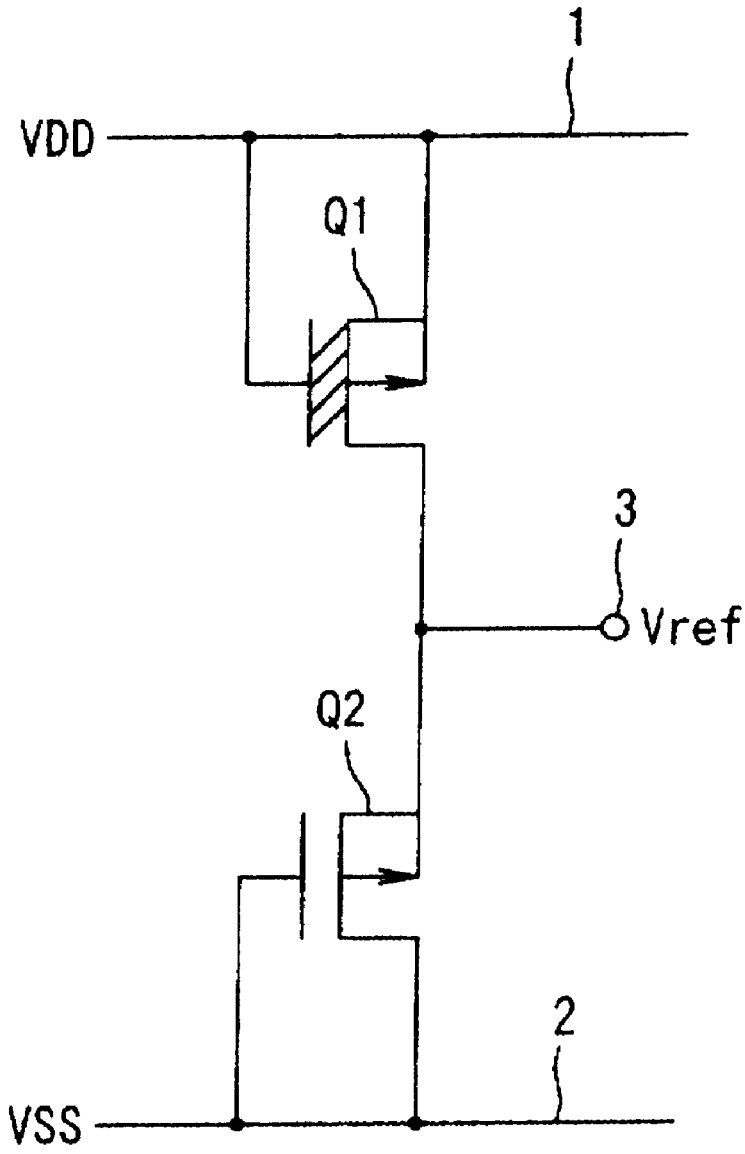
FIG. 1 shows a circuit diagram of a structure in accordance with a first embodiment of the present invention.

FIG. 1 shows a circuit diagram of a circuit structure of a reference voltage circuit in accordance with a first embodiment of the present invention.

In the reference voltage circuit in accordance with the first embodiment of the present invention, as shown in FIG. 1, a depletion type PMOS transistor Q1 and an enhancement type PMOS transistor Q2 are serially connected to each other. The serial circuit is connected between a power supply line 1 and a power supply line 2, and a voltage corresponding to a difference (Vtp2−Vtp1) between a threshold voltage Vtp2 of the PMOS transistor Q2 and a threshold voltage Vtp1 of the PMOS transistor Q1 is generated as a reference voltage Vref. The reference voltage Vref is output from an output terminal 3.

Moreparticularly, the PMOS transistor Q1 has a gate electrode and a source electrode connected to each other, wherein the mutually connected section is connected to the power supply line 1. The PMOS transistor Q1 also has a drain electrode connected to a source electrode of the PMOS transistor Q2 and the output terminal 3. The PMOS transistor Q2 has a gate electrode and a drain electrode connected to each other, wherein the mutually connected section is connected to the power supply line 2. The source electrode of the PMOS transistor Q2 is connected to the output terminal 3. Also, a positive power supply voltage VDD is supplied to the power supply line 1, and a negative power supply voltage VSS is supplied to the power supply line 2.

Next, one example of a structure of the PMOS transistors Q1 and Q2 is described with reference to FIG. 2.

Figure 2:
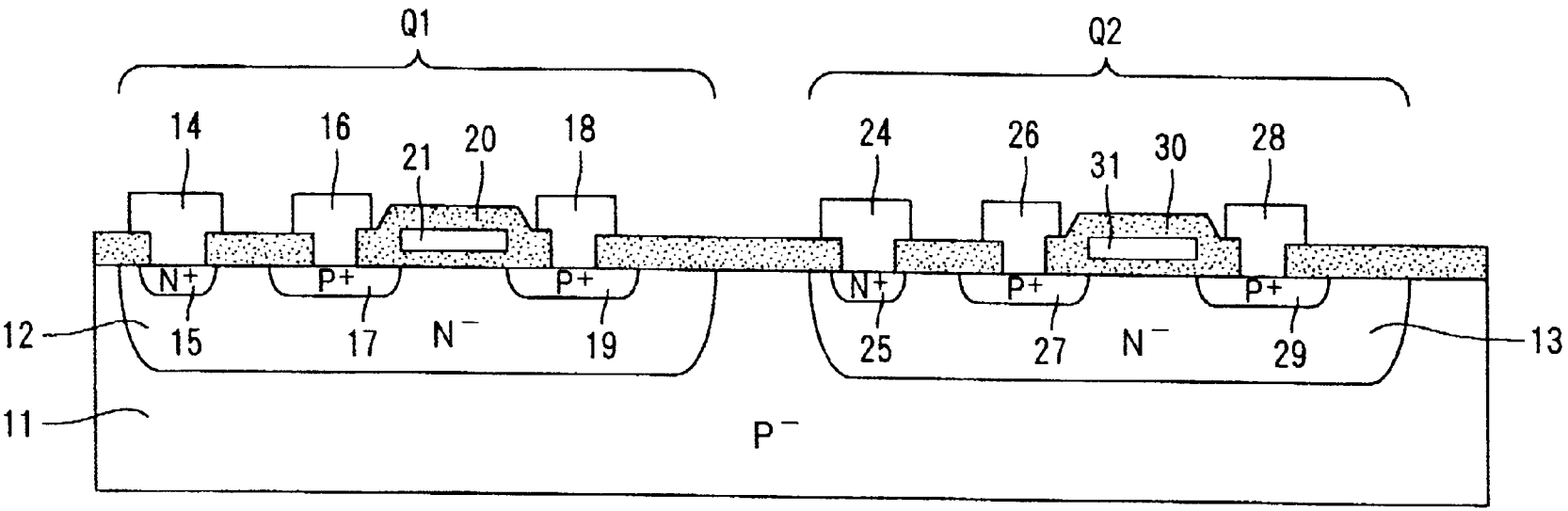
FIG. 2 shows a cross-sectional view of an example of a physical structure of the first embodiment.

The PMOS transistors Q1 and Q2 are formed on a $P^-$ substrate 11, respectively, as shown in FIG. 2. More specifically, they are formed in $N^-$ wells 12 and 13 that are formed in the $P^-$ substrate 11.

An $N^+$ diffusion layer 15 that is connected to a substrate terminal 14 of the PMOS transistor Q1, a $P^+$ diffusion layer 17 that is connected to a source terminal 16 thereof, and a $P^+$ diffusion layer 19 that is connected to a drain terminal 18 thereof are formed in the $N^-$ well 12. A dielectric film 20 composed of silicon oxide is formed at a specified location over the $N^-$ well 12, and a gate electrode 21 of the PMOS transistor Q1 is formed in the dielectric film 20. The gate electrode 21 is formed from polysilicon including a P-type impurity, and has a $P^+$ polarity.

An $N^+$ diffusion layer 25 that is connected to a substrate terminal 24 of the PMOS transistor Q2, a $P^+$ diffusion layer 27 that is connected to a source terminal 26 thereof, and a $P^+$ diffusion layer 29 that is connected to a drain terminal 28 thereof are formed in the $N^-$ well 13. A dielectric film 30 composed of silicon oxide is formed at a specified location over the $N^-$ well 13, and a gate electrode 31 of the PMOS transistor Q2 is formed in the dielectric film 30. The gate electrode 31 is formed from polysilicon including an N-type impurity, and has an $N^+$ polarity.

For the PMOS transistors Q1 and Q2 having the structure described above, the PMOS transistor Q1 is a depletion type transistor, and the PMOS transistor Q2 is an enhancement type transistor. The reason why the PMOS transistor Q1 is a depletion type transistor is described below.

The threshold voltage Vtp1 of the PMOS transistor Q1 can be made lower than the threshold voltage Vtp2 of the PMOS transistor Q2. This is because the polarities of the gate electrodes of the PMOS transistors Q1 and Q2 are different. Accordingly, the work functions $\phi_M$ of the gate electrodes are different, whereby the threshold voltages become different. The work function of a gate electrode is greater when the polarity of the gate electrode is $P^+$. Also, the work function $\phi_M$ itself can be adjusted by the impurity concentration of the gate electrode.

Therefore, adjusting the impurity concentration of the gate electrodes and the concentration of the wells can change the work functions $\phi_M$ of the gate electrodes and the work function $\phi_S$ of the silicon substrate/, and the PMOS transistor Q1 can be made into a depletion type transistor. In other words, its threshold voltage Vtp1 can be made to have a relation Vtp1<0.

Next, the reason why the threshold voltage Vtp1 of the PMOS transistor Q1 is lower than the threshold voltage Vtp2 of the PMOS transistor Q2 is described in detail.

The threshold voltage Vtp of the PMOS transistor is generally determined by Formula (1) shown below.

$$\mathrm{Vtp}=-\{2\phi_F+\phi_M-\phi_S-(Q_B/C_0)-(Q_{SS}/C_0)\} \quad (1)$$

In Formula (1), $\phi_F$ is Fermi level of the silicon substrate, $\phi_M$ is a work function of the gate electrode, $\phi_S$ is a work function of the silicon substrate, $Q_B$ is a charge amount in the surface of the silicon, $Q_{SS}$ is an interfacial charge amount between the silicon and the oxide film, and $C_0$ is a capacity per unit area of the gate.

In Formula (1), the work function $\phi_M$ of the gate electrode is singly determined by the material of the gate electrode. Also, the work function $\phi_S$ of the silicon substrate may be singly determined if the impurity distribution is uniform.

Therefore, in the case that the gate electrode is formed from polysilicon, a change in the concentration of the impurity to the gate electrode changes the work function $\phi_M$ of the gate electrode. In comparing the work function $\phi_{MP}$ of a polysilicon gate electrode having a $P^+$ polarity with the work function $\phi_{MN}$ of a polysilicon gate electrode having an $N^+$ polarity, it is noted that the work function of the polysilicon gate electrode having the $P^+$ polarity is larger.

In other words, the work function $\phi_{MP}$ and the work function $\phi_{MN}$ have a relation defined by Formula (2) as follows:

$$\phi_{MP}-\phi_{MP}>0 \quad (2)$$

As a result, the threshold voltage Vtp1 of the PMOS transistor Q1 and the threshold voltage Vtp2 of the PMOS transistor Q2 are represented by Formula (3) and Formula (4), respectively, as follows:

$$\mathrm{Vtp1}=-\{2\phi_F+\phi_{MP}-\phi_S-(Q_B/C_0)-(a_{SS}/C_0)\} \quad (3)$$

$$\mathrm{Vtp2}=-\{2\phi_F+\phi_{MN}-\phi_S-(Q_B/C_0)-(Q_{SS}/C_0)\} \quad (4)$$

Furthermore, the following Formula (5) is established according to Formulas (2) through (4).

$$\mathrm{Vtp2}-\mathrm{Vtp1}=\phi_{MP}-\phi_{MN}>0 \quad (5)$$

It is understood from Formula (5) that the threshold voltage Vtp1 of the PMOS transistor Q1 is lower than the threshold voltage Vtp2 of the PMOS transistor Q2.

Next, an operation of the reference voltage circuit in accordance with the first embodiment of the present invention having the structure described above is explained with reference to FIG. 1.

Since the PMOS transistor Q1 is a depletion type transistor, current flows even when its gate-source voltage is zero. The PMOS transistor Q1 normally operates within a range that a power supply voltage VDD is supplied so as to establish a relation of Vgs−Vtp=0−Vtp<Vds, in other words, a relation of Vgs−Vtp<Vds when a gate-source voltage is Vgs, a threshold voltage is Vtp and a drain-source voltage is Vds. The PMOS transistor Q1 also operates in the saturation region in this instance. Therefore, the drain current I1 in the PMOS transistor Q1 is represented by Formula (6) as follows:

$$I1=\beta/2(0-Vtp1)^2 \quad (6)$$

It is noted that, in Formula (6), β is a parameter to be determined by the process.

Also, the PMOS transistor Q2 also operates in the saturation region, since its Vgs=Vds, a relation of Vgs−Vtp<Vds is established. Therefore, the drain current I2 in the PMOS transistor Q2 is represented by Formula (7) as follows:

$$I2=\beta/2(Vref-VSS-Vtp2)^2 \quad (7)$$

It is noted that, in Formula (7), Vref of the output terminal 3 is a reference voltage, and VSS is a power supply voltage.

When the current that flows in the output terminal 3 is zero, Formula (6) is equal to Formula (7), and the following Formula (8) is obtained.

$$0-Vtp1=Vref-VSS-Vtp2 \quad (8)$$

Given with Formula (8), a voltage between the output terminal 3 and the power supply voltage VSS, namely, the reference voltage Vref is given by Formula (9) as follows:

$$Vref=VSS+(Vtp2-Vtp1) \quad (9)$$

In Formula (9), the threshold voltage Vtp1 and the threshold voltage Vtp2 has a relation of Vtp2>Vtp1, such that a constant voltage defined by a difference (Vtp2−Vtp1) between the threshold voltage Vtp1 and the threshold voltage Vtp2 based on the power supply voltage VSS as a reference can be obtained as the reference voltage Vref. Therefore, the reference voltage Vref does not depend on variations in the power supply voltage VDD and becomes constant.

Figure 3:
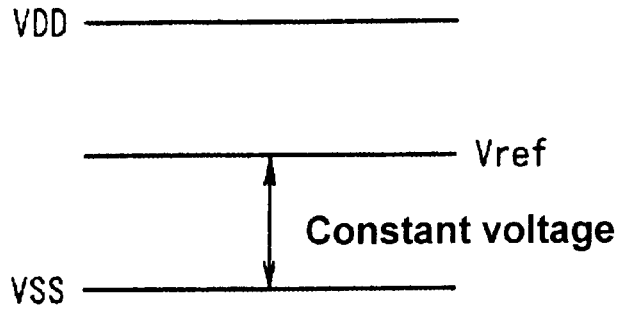
FIG. 3 shows a relation between a power supply voltage and a reference voltage in the first embodiment.

It is noted that the relation among the power supply voltage VDD, the reference voltage Vref and the power supply voltage VSS is shown in FIG. 3.

Next, a reference voltage circuit in accordance with a second embodiment of the present invention is described with reference to FIG. 4.

Figure 4:
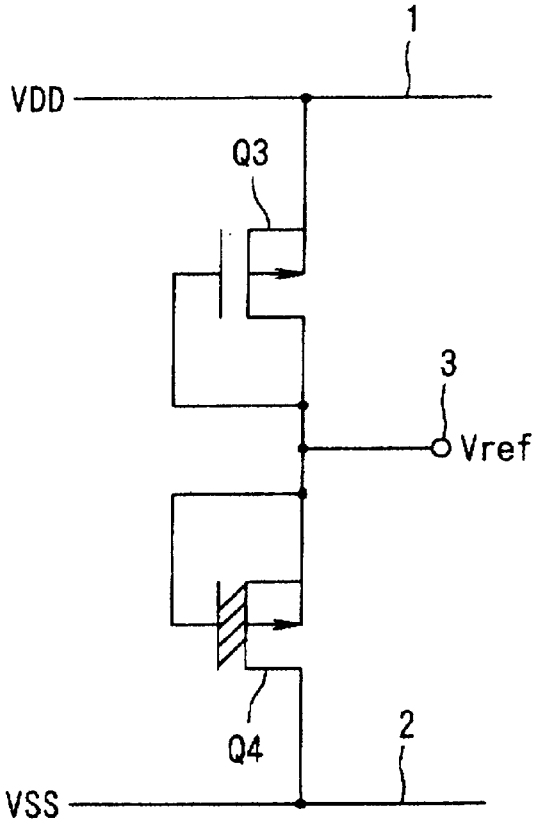
FIG. 4 shows a circuit diagram of a structure in accordance with a second embodiment of the present invention.

In the reference voltage circuit in accordance with the second embodiment of the present invention, as shown in FIG. 4, an enhancement type PMOS transistor Q3 and a depletion type PMOS transistor Q4 are serially connected to each other, wherein the serial circuit is connected between a power supply line 1 and a power supply line 2. A voltage corresponding to a difference (Vtp3−Vtp4) between a threshold voltage Vtp3 of the PMOS transistor Q3 and a threshold voltage Vtp4 of the PMOS transistor Q4 is generated as a reference voltage Vref, and the reference voltage Vref is output from an output terminal 3.

It is noted that the reference voltage circuit in accordance with the second embodiment of the present invention corresponds to the one in which the PMOS transistor Q1 and the PMOS transistor Q2 of the first embodiment shown in FIG. 1 are disposed in mutually reversed locations.

More particularly, the PMOS transistor Q3 has a source electrode that is connected to the power supply line 1, and a gate electrode and a drain electrode thereof being connected to one another, wherein the mutually connected section is connected to the output terminal 3 and a source electrode of the PMOS transistor Q4. Also, the PMOS transistor Q4 has a gate electrode and the source electrode connected to each other, wherein the mutually connected section is connected to the output terminal 3. A drain electrode of the PMOS transistor Q4 is connected to the power supply line 2.

The PMOS transistor Q3 has the same structure as that of the PMOS transistor Q2, and its gate electrode is composed of polysilicon including an N-type impurity and has a $N^+$ polarity. Also, the PMOS transistor Q4 has the same structure as that of the PMOS transistor Q1, and its gate electrode is composed of polysilicon including a P-type impurity and has a $P^+$ polarity.

Next, an operation of the reference voltage circuit in accordance with the second embodiment of the present invention having the structure described above is explained with reference to FIG. 4.

Since the PMOS transistors Q3 and Q4 operate in the saturation region, the drain currents I3 and I4 of the respective PMOS transistors Q3 and Q4 are represented by Formulas (10) and (11), respectively, as follows:

$$I3=\beta/2(VDD-Vref-Vtp3)^2 \quad (10)$$

$$I4=\beta/2(0-Vtp4)^2 \quad (11)$$

Here, in Formula (10), Vref is a reference voltage, VDD is a power supply voltage, and Vtp3 is a threshold voltage of the PMOS transistor Q3. Also, in Formula (11), Vtp4 is a threshold voltage of the PMOS transistor Q4.

When the current that flows out from the output terminal 3 is zero, Formula (10) equals to Formula (11), and the following Formula (12) is obtained.

$$VDD-Vref-Vtp3=0-Vtp4 \quad (12)$$

Based on Formula (12), a voltage between the output terminal 3 and the power supply voltage VDD, namely, the reference voltage Vref is given by Formula (13) as follows:

$$Vref=VDD-(Vtp3-Vtp4) \quad (13)$$

In Formula (13), the threshold voltage Vtp3 and the threshold voltage Vtp4 has a relation of Vtp3>Vtp4, such that a constant voltage (Vtp3−Vtp4) defined by a difference between the threshold voltage Vtp3 and the threshold voltage Vtp4 based on the power supply voltage VDD as a reference can be obtained as the reference voltage Vref. Therefore, the reference voltage Vref does not depend on variations in the power supply voltage VSS and becomes constant.

Figure 5:
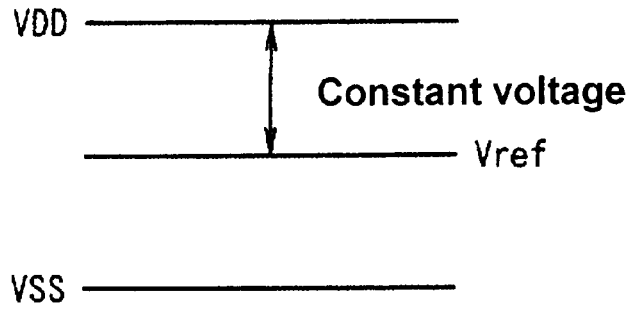
FIG. 5 shows a relation between a power supply voltage and a reference voltage in the second embodiment.

It is noted that the relation among the power supply voltage VDD, the reference voltage Vref and the power supply voltage VSS is shown in FIG. 5.

Next, a reference voltage circuit in accordance with a third embodiment of the present invention is described with reference to FIG. 6.

Figure 6:
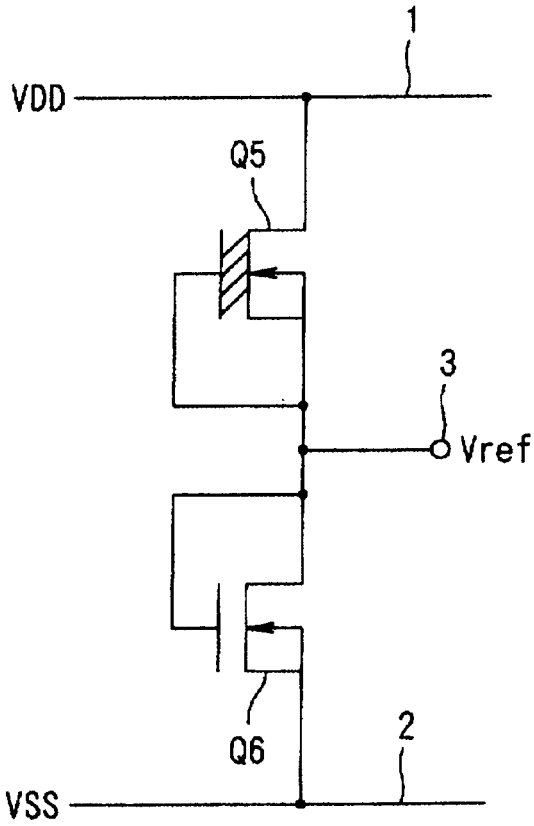
FIG. 6 shows a circuit diagram of a structure in accordance with a third embodiment of the present invention.

In the reference voltage circuit in accordance with the third embodiment of the present invention, as shown in FIG. 6, a depletion type NMOS transistor Q5 and an enhancement type NMOS transistor Q6 are serially connected to each other. The serial circuit is connected between a power supply line 1 and a power supply line 2, and a voltage corresponding to a difference (Vtp6−Vtp5) between a threshold voltage Vtp6 of the NMOS transistor Q6 and a threshold voltage Vtp5 of the NMOS transistor Q5 is generated as a reference voltage Vref. The reference voltage Vref is output from an output terminal 3.

More particularly, the NMOS transistor Q5 has a drain electrode that is connected to the power supply line 1, and a gate electrode and a source electrode connected to each other, wherein the mutually connected section is connected to a drain terminal of the NMOS transistor Q6 and the output terminal 3. The NMOS transistor Q6 has a gate electrode and a drain electrode connected to each other, wherein the mutually connected section is connected to the output terminal 3. A source electrode of the NMOS transistor Q6 is connected to the power supply line 2.

Next, a structure of the NMOS transistors Q5 and Q6 is described with reference to FIG. 7.

Figure 7:
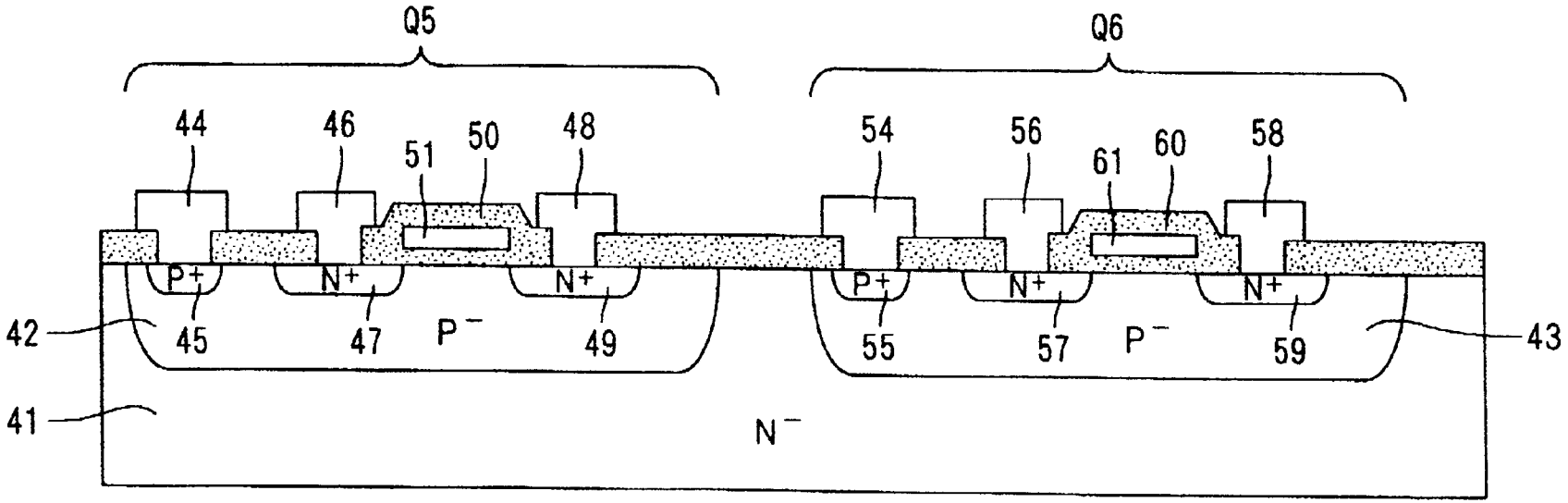
FIG. 7 shows a cross-sectional view of an example of a physical structure of the third embodiment.

The NMOS transistors Q5 and Q6 are formed on an substrate 41, respectively, as shown in FIG. 7. More specifically, they are formed in the $P^-$ wells 42 and 43 that are formed in the $N^-$ substrate 41.

An $N^+$ diffusion layer 45 that is connected to a substrate terminal 44 of the NMOS transistor Q5, an $N^+$ diffusion layer 47 that is connected to a source terminal 46 thereof, and an $N^+$ diffusion layer 49 that is connected to a drain terminal 48 thereof are formed in the $P^-$ well 42. A dielectric film 50 composed of silicon oxide is formed at a specified location over the $P^-$ well 42, and a gate electrode 51 of the NMOS transistor Q5 is formed in the dielectric film 50. The gate electrode 51 is formed from polysilicon including an N-type impurity.

A $P^+$ diffusion layer 55 that is connected to a substrate terminal 54 of the NMOS transistor Q6, an $N^+$ diffusion layer 57 that is connected to a source terminal 56 thereof, and an $N^+$ diffusion layer 59 that is connected to a drain terminal 58 thereof are formed in the $P^-$ well 43. A dielectric film 60 composed of silicon oxide is formed at a specified location over the $P^-$ well 43, and a gate electrode 61 of the NMOS transistor Q6 is formed in the dielectric film 60. The gate electrode 61 is formed from polysilicon including a P-type impurity.

For the NMOS transistors Q5 and Q6 having the structure described above, the NMOS transistor Q5 is a depletion type transistor, and the NMOS transistor Q6 is an enhancement type transistor. The reason why the NMOS transistor Q5 is a depletion type transistor is the same as described above for the PMOS transistors Q1 and Q2.

Next, an operation of the reference voltage circuit in accordance with the third embodiment of the present invention having the structure described above is described with reference to FIG. 6.

Since the NMOS transistor Q5 is a depletion type transistor, current flows even when its gate-source voltage is zero. Also, the NMOS transistors Q5 and Q6 operate in the saturated region. The reasons therefor are the same as those described above with respect to the PMOS transistors Q1 and Q2 in the first embodiment. Therefore, the drain current I5 in the NMOS transistor Q5 is represented by Formula (14) as follows:

$$I5=\beta/2(0-Vtp5)^2 \tag{14}$$

Also, the drain current I6 in the NMOS transistor Q6 is represented by Formula (15) as follows:

$$I6=\beta/2(Vref-VSS-Vtp6)^2 \tag{15}$$

In Formula (15), Vref is a reference voltage, VSS is power supply voltage, and Vtp6 is a threshold voltage of the NMOS transistor Q6.

When the current that flows in the output terminal 3 is zero, Formula (14) is equal to Formula (15), and the following Formula (16) is obtained.

$$0-Vtp5=Vref-VSS-Vtp6 \tag{16}$$

From Formula (16), a voltage between the output terminal 3 and the power supply voltage VSS, namely, the reference voltage Vref is given by Formula (17) as follows:

$$Vref=VSS+(Vtp6-Vtp5) \tag{17}$$

In Formula (17), the threshold voltage Vtp6 and the threshold voltage Vtp5 has a relation of Vtp6>Vtp5, such that a constant voltage (Vtp6−Vtp5) defined by a difference between the threshold voltage Vtp6 and the threshold voltage Vtp5 based on the power supply voltage VSS as a reference can be obtained as the reference voltage Vref. Therefore, the reference voltage Vref does not depend on variations in the power supply voltage VDD and becomes constant.

Next, a reference voltage circuit in accordance with a fourth embodiment of the present invention is described with reference to FIG. 8.

Figure 8:
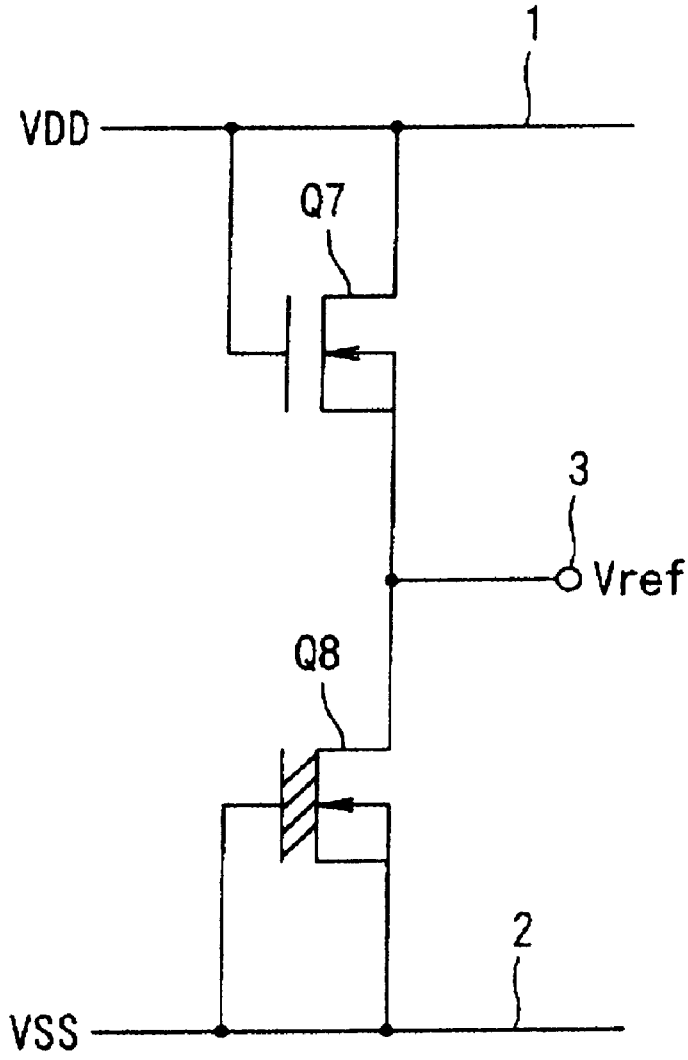
FIG. 8 shows a circuit diagram of a structure in accordance with a fourth embodiment of the present invention.

In the reference voltage circuit in accordance with the fourth embodiment of the present invention, as shown in FIG. 8, an enhancement type NMOS transistor Q7 and a depletion type NMOS transistor Q8 are serially connected to each other. The serial circuit is connected between a power supply line 1 and a power supply line 2, and a voltage corresponding to a difference (Vtp7−Vtp8) between a threshold voltage Vtp7 of the NMOS transistor Q7 and a threshold voltage Vtp8 of the NMOS transistor Q8 is generated as a reference voltage Vref. The reference voltage Vref is output from an output terminal 3.

It is noted that the reference voltage circuit in accordance with the fourth embodiment of the present invention corresponds to the one in which the NMOS transistor Q5 and the NMOS transistor Q6 of the third embodiment in FIG. 6 are disposed in mutually reversed locations.

More particularly, the NMOS transistor Q7 has a gate electrode and a drain electrode connected to one another, wherein the mutually connected section is connected to the power supply line 1., The Q7 also has a source electrode that is connected to the output terminal 3. Also, the NMOS transistor Q8 has a gate electrode and a source electrode connected to the power supply line 2, and a drain electrode connected to the output terminal 3.

The NMOS transistor Q7 has the same structure as that of the NMOS transistor Q6, and its gate electrode is formed from polysilicon including a P-type impurity and has a $P^+$ polarity. Also, the NMOS transistor Q8 has the same structure as that of the NMOS transistor Q5, and its gate electrode is formed from polysilicon including an N-type impurity and has an $N^+$ polarity.

Next, an operation of the reference voltage circuit in accordance with the fourth embodiment of the present invention having the structure described above is described with reference to FIG. 8.

Since the NMOS transistors Q7 and Q8 operate in the saturation region for the reasons similar to those for the NMOS transistors Q5 and Q6, the drain currents I7 and I8 of the NMOS transistors Q7 and Q8 are given respectively by Formulas (18) and (19), as follows:

$$I7=\beta/2(VDD-Vref-Vtp7)^2 \tag{18}$$

$$I8=\beta/2(0-Vtp8)^2 \tag{19}$$

Here, in Formula (18), Vref is a reference voltage, VDD is power supply voltage, and Vtp7 is a threshold voltage of the NMOS transistor Q7. Also, in Formula (19), Vtp8 is a threshold voltage of the NMOS transistor Q8.

When the current that flows out from the output terminal 3 is zero, Formula (18) equals to Formula (19) and the following Formula (20) is obtained.

$$VDD-Vref-\mathrm{Vtp}\mathbf{7}=0-\mathrm{Vtp}\mathbf{8} \quad (20)$$

Based on Formula (20), a voltage between the output terminal 3 and the power supply voltage VDD, namely, the reference voltage Vref is given by Formula (21) as follows:

$$Vref=VDD-(\mathrm{Vtp}\mathbf{7}-\mathrm{Vtp}\mathbf{8}) \quad (21)$$

In Formula (21), the threshold voltage Vtp7 and the threshold voltage Vtp8 has a relation of Vtp7>Vtp8, such that a constant voltage (Vtp7−Vtp8) defined by a difference between the threshold voltage Vtp7 and the threshold voltage Vtp8 based on the power supply voltage VDD as a reference can be obtained as the reference voltage Vref. Therefore, the reference voltage Vref does not depend on variations in the power supply voltage VSS and becomes constant.

As described above, with each of the reference voltage circuits in accordance with the first embodiment through the fourth embodiment, a specified reference voltage can be obtained, with a simple structure, but without being affected by influences that are caused by fluctuations in the power supply voltage.

As described above, in accordance with the present invention, a reference voltage circuit that can obtain a specified reference voltage with a simple structure, but without being affected by influences that are caused by fluctuations in the power supply voltage.

The entire disclosure of Japanese Patent Application No. 2000-331251(P) filed Oct. 30, 2000 is incorporated by reference herein.

What is claimed is:

1. A reference voltage circuit comprising:

a depletion type first PMOS transistor and an enhancement type second PMOS transistor serially connected to each other;

wherein a gate electrode of the first PMOS transistor is formed from polysilicon including a P-type impurity and connected to a source electrode thereof;

a gate electrode of the second PMOS transistor is formed from polysilicon including an N-type impurity and connected to a drain electrode thereof;

a first power supply line is connected to the gate electrode and a source electrode of the first PMOS transistor;

a second power supply line is connected to the gate electrode and a drain electrode of the second PMOS transistor; and a voltage corresponding to a difference between a threshold voltage of the second PMOS transistor and a threshold voltage of the first PMOS transistor is generated at a common connection section of both PMOS transistors as a reference voltage.

2. The reference voltage circuit of claim 1 wherein the first power supply line provides a positive voltage and the second power supply line provides a negative voltage.

3. The reference voltage circuit of claim 1 wherein the threshold voltage of the second PMOS transistor is greater than the threshold voltage of the first PMOS transistor.

4. The reference voltage circuit of claim 1 wherein the first PMOS transistor and the second PMOS transistor operate in saturation.

5. The reference voltage circuit of claim 1 wherein the reference voltage is taken directly from the common connection section of both PMOS transistors.

* * * * *

UNITED STATES PATENT AND TRADEMARK OFFICE

CERTIFICATE OF CORRECTION

PATENT NO. : 6,628,161 B2
DATED : September 30, 2003
INVENTOR(S) : Masuhide Ikeda It is certified that error appears in the above-identified patent and that said Letters Patent is hereby corrected as shown below:

Title page,
Item [75], Inventors, "Nagano-ken (JP)" should be -- Fujimi-cho (JP) --

Column 3,
Line 20, "Moreparticularly," should be -- More particularly, --

Column 4,
Line 46, 2nd occurrence of "$\phi_{MP}$" should be -- $\phi_{MN}$ --
Line 53, "($a_{ss}$" should be -- ($Q_{SS}$ --

Column 7,
Line 16, before "substrate" insert -- N- --

Signed and Sealed this

First Day of June, 2004

JON W. DUDAS
*Acting Director of the United States Patent and Trademark Office*